US005720454A

United States Patent [19]

Bachetti et al.

[11] Patent Number: 5,720,454

[45] Date of Patent: Feb. 24, 1998

[54] AUDIOFREQUENCY TRACK CIRCUIT WITH DATA TRANSMISSION (DIGITAL TC); TRANSCEIVER INTERFACE

[75] Inventors: Vittorio Bachetti, Imola; Maurizio Carpanelli, Bologna; Andrea Giovannucci, Bologna; Alberto Regazzi, Bologna, all of Italy

[73] Assignee: Sasib Railway S.p.A., Bologna, Italy

[21] Appl. No.: 724,401

[22] Filed: Oct. 2, 1996

[30] Foreign Application Priority Data

Oct. 27, 1995 [IT] Italy ..... GE95A0114

[51] Int. Cl.[6] ..... B61L 21/00

[52] U.S. Cl. ..... 246/34 R; 246/34 B; 246/122 R; 246/178; 340/988

[58] Field of Search ..... 246/29 R, 24 B, 246/34 R, 34 D, 34 CT, 122 R, 167 R, 177, 178; 340/933, 941, 988

[56] References Cited

U.S. PATENT DOCUMENTS 3,820,100 6/1974 Ballinger et al. ..... 246/249
3,990,040 11/1976 Gleitz et al. ..... 340/436
4,728,063 3/1988 Petit et al. ..... 246/34 R

FOREIGN PATENT DOCUMENTS 34 35 522 A 4/1986 Germany .
2 162 353 1/1986 United Kingdom .

*Primary Examiner*—S. Joseph Morano
*Attorney, Agent, or Firm*—Larson & Taylor

[57] ABSTRACT

A track circuit is used in a railway plant or the like, and comprises a track segment which is isolated electrically from the adjacent segments by electrical splices which consist of a conductor connecting the rails in the shape of an "S" laid flat in the direction of the axis of the track. Stationary ground transmission and reception units we provided for each track segment, and on-board mobile reception units we provided on the trains in transit. The data or the information transmitted by the ground units to the on-board units being conveyed through the rails of each isolated track segment when the train is travelling thereon. According to the invention, with each track segment there is associated a compensation network consisting of capacitors connected to the rails of the track segment and suitably spaced apart. Particular embodiments are provided of the electrical splice and of the transmission/reception units.

19 Claims, 4 Drawing Sheets

AUDIOFREQUENCY TRACK CIRCUIT WITH DATA TRANSMISSION (DIGITAL TC); TRANSCEIVER INTERFACE

BACKGROUND OF THE INVENTION

The subject of the invention is a track circuit for railway plant, or the like, comprising a track segment of preset length which, by employing audio-frequencies, can be isolated electrically from the adjacent segments by means of so-called electrical splices. The splices each comprise a conductor which connects the rails at the ends of each track segment and which exhibits an "S" shape laid flat in the direction of the axis of the track and with the branches which are disposed in the direction of the track arranged along the internal sides of the corresponding rails. Stationary ground transmission and reception units are provided for each track segment and corresponding on-board mobile reception units are provided on the trains in transit. The data or the information transmitted by the ground units to the on-board units is conveyed through the rails of each isolated track segment when the train travels by thereon.

Various mutually conflicting requirements need to be taken into account when producing track circuits. On the one hand, it is advantageous to avoid mechanical discontinuities in the rails, whereas on the other hand mutual electrical separation of the track segments is required in order to be able to pinpoint the position of the train and associate a specified set of information with each segment, this information generally varying as the circuit to which it refers varies. This is achieved with the help of electrical splices which confine the information transmitted through the track to the particular track segment. In this case, moreover, it is necessary to uphold or adhere to the requirements of ensuring track segments of a certain length, keeping the transmission power limited while avoiding attenuation of the transmitted signals to an extent where the signals become unintelligible on reception. The track circuit must be able to operate at frequencies such that it is unaffected by the traction currents and at the same time the frequency bands used have to be sufficiently wide as to allow the transmission of a large amount of information.

Finally, the track circuit must be produced in the simplest possible manner, and this applies, in particular to the electrical splices, since the latter cannot be duplicated and, additionally, the regularity of operation of the whole system depends on them.

The electrical splices employed in the track circuit of the invention constitute a reformulation of those already known for many years in German technology, Such splices are very economical and have considerable reliability of operation. They are easy to calibrate and exhibit considerable stability. The pass bands permitted by these electrical splices and by the relevant track segments are very wide and the transmission power required is not excessive. However, these electrical splices impose limitations both as regards the maximum length of the track segment because the shunt at the center of the region of the splice is less than that occurring at the ends, and as regards the directionality of the signals transmitted, or their confinement to the desired track segment, which is with the ground/on-board information and with the basic information on the position of the train.

Furthermore, for high per kilometer conductance values in the region of the splice it is not possible to monitor the breakage of any stretches of rail, and moreover, independently of the conductance, so-called pre-shunt phenomena may appear due to the formation of very low impedance paths caused by the train which short-circuits the input impedance of the track segment adjacent to that considered. In this case the very low impedance path causes either untimely occupation before the train has entered the segment considered, or the prolongation of occupation after the last axle has left the circuit.

SUMMARY OF THE INVENTION

The object of the invention is therefore to produce a track circuit of the type described above, which by virtue of the relatively simple and inexpensive expedients allows the use of an electrical splice similar to that of German technology, thereby obviating any of the above drawbacks and thus guaranteeing greater length of the track segments, effective confinement of the energy associated with each track segment, and the transmission of a very large quantity of data, together with a high level of safety.

The invention achieves the above objects with a track circuit of the type described above in which with each track segment, delimited at its ends by an electrical splice, there is associated a compensation network consisting of capacitors.

According to a further characteristic, transmission is effected with carriers in the audiofrequency range and by virtue of so-called MSK (Minimum Frequency Shift Keying) modulation. Transmission of the information in two adjacent track segments is performed on two different frequency bands.

The data and the information are coded in the form of digital signals.

Six transmission channels are provided, each with a different carrier frequency and with an identical preset set bandwidth, the carriers being differentiated from one another by an integer bandwidth multiplication factor. Channels with frequencies relating to odd multiplication factors are used for transmissions on the track in one direction and those with frequencies relating to even multiplication factors for transmissions on the track in the opposite direction. The channels are distributed over segments of each track, in such a way that transmissions always take place at different frequencies in the adjacent track segments.

To eliminate a possible region of non-coverage (shunt 0.15 ohms) in the central region of the electrical splice, the electric cable is S-shaped with asymmetric bows in the direction of the axis of the track. In each splice the bow of greater length is associated with the track segment in which transmission takes place through the lower frequency channel relative to the adjacent channel.

Furthermore, and for the same reason, the value of the shunt at the edges of the splice is kept as high as possible.

To obviate the further drawback of a failure to monitor the breakage of any stretches of rail within the compass of the electrical splice it is necessary to make the dynamic range of operation of the track circuit lower than the dynamic range caused by the breakage of the rails and for this purpose it is advantageous to furnish the transmitter with a suitable output impedance and especially to limit the maximum permissible conductance of the rails to values below those commonly used for low-frequency circuits. In particular, on the basis of experience acquired on tracks with cement sleepers, a conductance of 0.2 S/km is used, which is substantially greater than the values generally encountered.

The advantages of the track circuit according to the invention are made clear from what is set forth above. Employing an electrical splice of German technology and track circuit compensation via a network of capacitors makes it possible to attain lengths of up to 2000 m for the track segment associated with each circuit, with an overall pass band able to allow audio-frequency transmission, carried out through a series of channels of appreciable width.

The electrical features (in particular as regards the maximum conductance) make it possible, in conjunction with the asymmetry of the splice, to detect any breakages in the rails in the region of the splice, and to provide compensation of the track to drastically lower the attenuation of the line (as well as the swing in the voltage received), so as to reduce the power delivered. The input impedance of the line becomes almost resistive and facilitates calibration of the electrical splices, increases the pass band thereof and makes it possible to approach the optimal matching conditions for the line so as to decrease phase distortion as far as possible, for optimal transmission of data.

The invention also relates to other characteristics which further enhance the above track circuit and which are the subject matter of the claims hereinbelow.

BRIEF DESCRIPTION OF THE DRAWINGS

The characteristic features of the invention and the advantages deriving therefrom will emerge in greater detail from the description of a few preferred embodiments, illustrated by way of non-limiting example in the appended drawings, in which.

DESCRIPTION OF THE PREFERRED EMBODIMENT OF THE INVENTION

Figure 1:
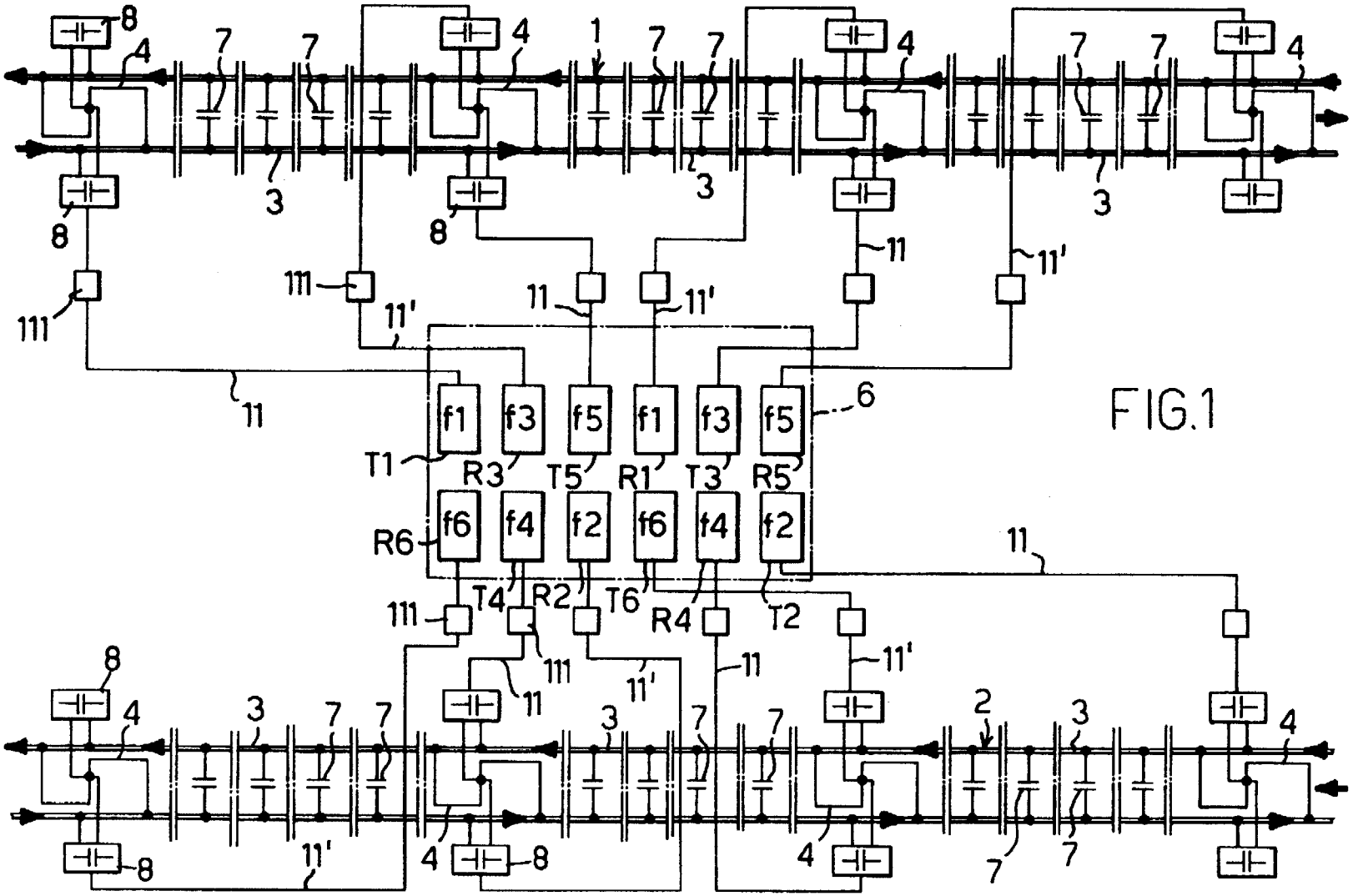
FIG. 1 illustrates diagrammatically a fragment of railway line consisting of one track running in each direction and comprising several track segments in succession.

With reference to the figures, in order to produce a track circuit, a track 1, 2 is subdivided into a succession of track segments 3 which are separated from one another only electrically by so-called electrical splices 4, while the rails exhibit no mechanical interruptions. The electrical splices 4 consist of conductors in the shape of an S laid flat, in such a way as to be oriented correspondingly with the longitudinal axis of the track 1, 2 and are joined at their ends to one of the two rails forming the said track. A reception and transmission unit T1, T2, T3, T4, T5, T6 and R1, R2, R3, R4, R5, R6 is connected to each track segment 3 at each of the two end electrical splices 4. The output for the transmission signal is connected to the S cable center point and to a rail, while the input for the reception signal is also connected to the center point of the cable and to the opposite rail of the same track.

Along each track segment 3, the rails are connected together at regular intervals by means of compensation capacitors 7.

Transmission and reception are carried out at audiofrequency on six channels, at six different frequencies and with a preset identical bandwidth for all the channels.

The modulation of the information signals coded in digital form is of the FSK (Frequency Shift Keying) type and in particular MSK, minimum frequency shift keying.

Advantageously the lower limit of the transmission band is 1.9 kHz, so that reception is largely immune to disturbances of traction with reference to DC electrified lines, within the realm of which disturbances the harmonics generated by current means are negligible as compared with the useful signal above 2 kHz.

With reference to FIG. 1, with each track segment 3 there is associated a preset transmission and reception channel operating at a different frequency from that of the reception and transmission channels associated with the two track segments 3 adjoining the segment 3 being considered.

In the presence of two tracks for travelling in the opposite directions, the transmission channels are distributed in such a way that transmissions on the two facing tracks are carried out at different frequencies. In particular, six transmission channels operating on six different frequency bands are provided which are differentiated from each other by an integer multiple shift by a preset bandwidth of the channel. The frequencies associated with odd shift factors f1, f3, f5 are distributed over the track segments 3 of the track 1, for example, while the frequencies f2, f4, f6 obtained with even factors are distributed over the segments 3 of the other track 2.

The bandwidth of each channel is set appropriately at 400 Hz, so that the lower limit of the transmission band is equal to 1.9 kHz, while the upper limit is equal to 4.3 kHz.

A choice of MSK minimum frequency shift keying is advantageous since it produces the minimum amplitude distortion.

The distribution of the six transmission channels, alternating in groups of three, respectively on the segments 3 of the tracks 1, 2, associated with the two directions makes it possible to alleviate the drawbacks due to the non-perfect directionality of the electrical splices 4 of German technology, thus avoiding noticeable interference between signals of equal frequency transmitted on neighboring allocated segments on the same track. Moreover, by actuating transmission on the tracks 1 and 2 on different bands, any problems of crosstalk are also eliminated.

The use of audiofrequencies and the considerable bandwidth of each transmission channel make it possible to transmit a considerable quantity of information at relatively high speed (400 bits/sec). However, it is possible either to transmit longer messages within the same time unit or, for the same message length, to employ less time for its transmission.

With reference to the network of compensation capacitors 7, the best compromise between costs and efficiency is obtained with a distance between the capacitors 7 of the order of magnitude of some hundred meters.

Figure 2:
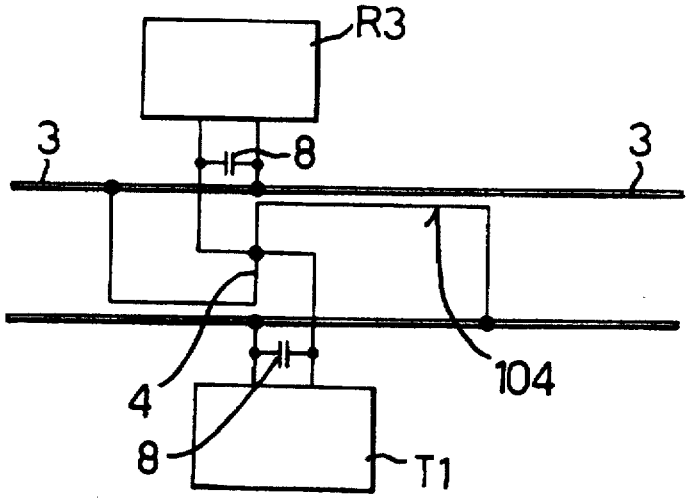
FIG. 2 is an enlarged feature in the region of an electrical splice according to FIG. 1.

As indicated in FIG. 2, in order to reduce as far as possible the region of non-coverage between two adjacent track segments 3 of two successive track circuits, due to the fact that in the central region of the splice the shunt becomes less than that present at the ends thereof, the invention provides for producing the electrical splice 4 in the guise of an asymmetric S, or with the turn 104 of greater length associated with the lower-frequency channel and, furthermore, at the ends of the splice the value of the shunt is kept as high as possible, in particular not less than about 0.5 ohms.

The tuning of the track segments 3 to the transmission and reception units T1 to T6 and R1 and R6, is effected by means of capacitive elements 8 connected in parallel and varying the spans of the electrical splices from 26 m for the f1/f3 coupling to 17.5 m for the f4/f6 coupling.

Such lengths of the electrical splices 4 may involve the danger of a failure to detect a breakage in the rails in the region of the splice. This problem is solved for a length of rail up to 1500 m by virtue of the asymmetry of the S cable of the electrical splice 4, in combination with a limitation in the maximum allowable conductance. In particular it is appropriate to fix the maximum conductance at 0.2 S/km rather than 0.5 S/km, this being the value used to size track circuits in which transmission takes place with low-frequency carriers.

In this case, the dynamic range of operation of the track circuit becomes less than the dynamic range caused by the breakage of the rail of the splices and is therefore detectable.

The capacitors 7 of the compensation network are chosen with a capacitance such as to guarantee a low attenuation of the line at the highest frequency emitted by the transmitter (4.3 kHz). This capacitance is of the order of a few tens of μF, preferably, for the configuration described, 25 μF.

Illustrated in FIGS. 3 to 7 are the block diagrams of the data modulation and demodulation units for transmission and reception in the track circuit according to the invention. For stretches of rail with a length of around 14 km, these units are congregated or grouped or in a single housing box 6 arranged in the mid-region of the stretch, in such a way that connection cables 11, 11' are not fed to the corresponding electrical splices 4 of length greater than 7 km. When the length of the cables exceeds 3.5 km, inductive compensation means are provided, indicated overall as 111. Furthermore, the different lengths between the transmission cable 11 and the reception cable 11' are electrically compensated for in-box, i.e., by circuitry within box 6, by virtue of a cable simulation network with passive components. Therefore, the regulation of the energy transmitted is independent of its direction of flow along the track circuit. As known, in fact, the supply extremity of the circuit must always be downstream with respect to the direction of travel of the train, so as to be able to receive the on-board signals. Means for reversing the flow of energy are also provided in the box 6, these being actuated mechanically via two relays (not illustrated) which are controlled by the logic of the plant and which effect a changeover on the two pairs of conductors.11, 11' relating to each circuit.

Congregating or unifying the modulation and demodulation units T1 to T6 and R1 to R6 for transmission and reception in box 6 makes it possible to position the units immediately near, i.e., directly adjacent, each other allowing two checking loops to be produced for each track segment 3, one loop 13 internal to the device, and one loop 12 external. The two checking loops, internal loop 13 and external loop 12, can be activated alternately depending on whether the track is occupied or free and make it possible to check the correctness of the information transmitted, thus eliminating the dangers due to disturbances and to incorrect transmission owing to malfunctioning of the signal modulation electronics.

Figure 4:
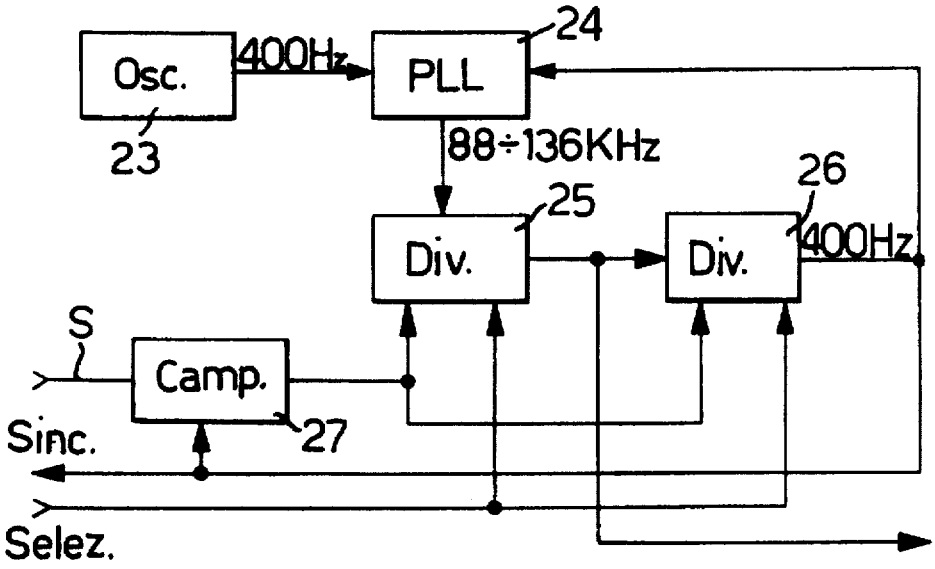
FIG. 4 illustrates a block diagram of the modulator.

The signal S in which the information and data to be transmitted are digitally coded, or the modulating signal, is sent simultaneously to a modulator 20 and through a delay network 21 to a comparison section 22. The modulator 20 shifts the frequency of one out of six audiofrequency carriers f1 to f6. The frequency can be chosen by mechanically (or electronically) programming a divider placed inside the modulator. With reference to FIG. 4, a base oscillator 23 generates a 400 Hz wave which is then multiplied by a suitable coefficient dependent on the pre-chosen channel and on the bit (1/0) required to be transmitted. The multiplier is produced with a phase lock circuit 24 and two programmable dividers 25, 26. The control signal for the power stage is tapped off at the output of the first divider 25. The 400 Hz signal present on the output of the second divider closes the loop of the multiplier and is used in the block 27 to sample, at the appropriate instant, the data S provided by the logic, which must be suitably synchronized.

Figure 3:
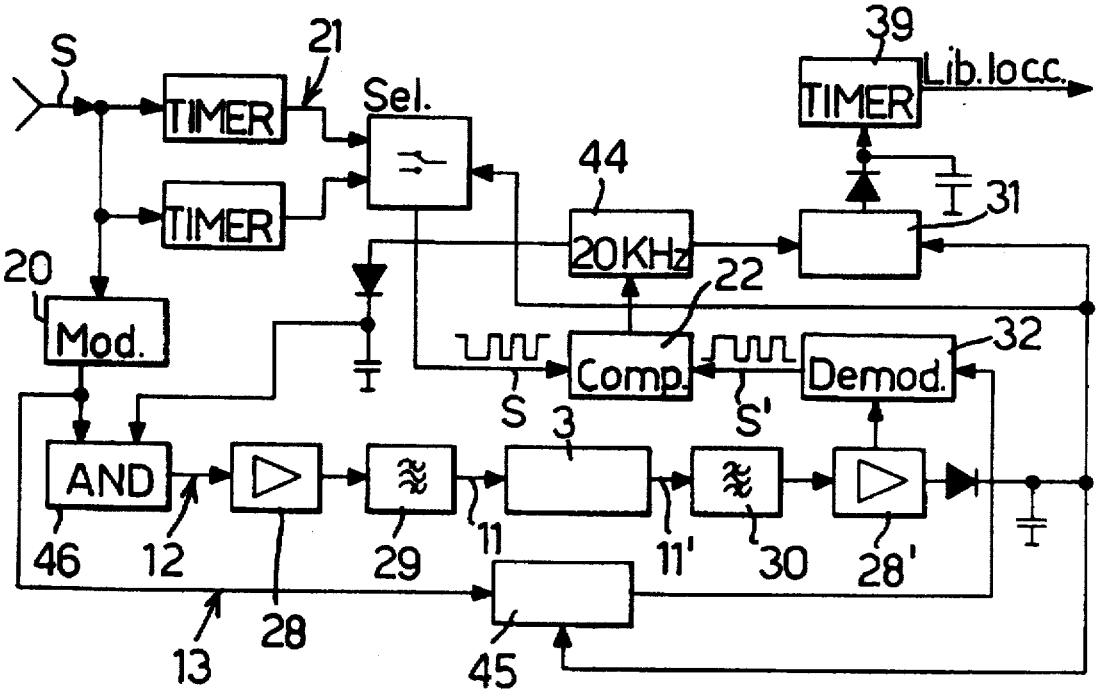
FIG. 3 illustrates a block diagram of the ground reception/transmission unit.

The modulated signal is subsequently amplified by an amplifier 28, as shown in FIG. 3, and filtered by means of a passive second-order Chebyschev filter 29 and then sent over connection cable 11 to the track segment 3. At the reception end the same signal S is again filtered through a fourth-order Butterworth network 30, amplified by an amplifer 28' and sent both to level metering section 31 and to a demodulator 32.

Figure 5:
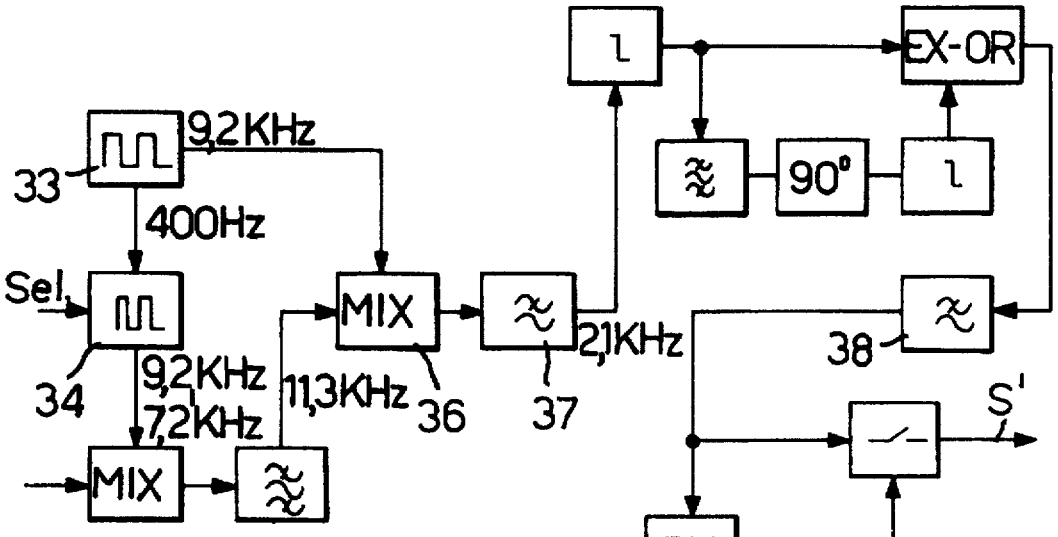
FIG. 5 illustrates a block diagram of the demodulator.

The demodulator 32, a block the diagram for which is illustrated in FIG. 5, is based on the "superheterodyne" principle typical of radio receivers. The base oscillator 33 generates a 400 Hz square wave which is then multiplied through a phase lock circuit (PLL) by an appropriate coefficient dependent on the pre-chosen channel. At the output of the local oscillator 34 there is a square wave of frequency equal to 400×23=9200 Hz for the first channel and 400×18 =7200 Hz for the sixth channel. Similarly the frequencies intermediate to that cited above, which are valid for channels 2 to 5, are all multiplied by the 400 Hz square wave. A frequency of 9.2 kHz is present on the second input of the second-conversion mixer 36. A low-pass filter 37 is therefore sufficient for the basic demodulation section, which converts the frequency shift in the modulated signal into a phase shift between the output and the input of an active bandpass filter 38, always to operate in the band of the first channel (1900 to 2300 Hz). This makes it possible, as for the modulator, to use the same circuits for all six channels.

The selection of the channel to be transmitted or received takes place by correctly setting three mechanical jumpers placed on the relevant card. The double conversion of the frequency translation section is made necessary because of the "imaginary bands" which also arise because the local oscillator 34 generates a square wave, i.e. a signal containing harmonics.

The modulating signal S', from which is extracted, by means of a phase lock circuit (PLL) 41, the 400 Hz synchronism signal which carries out the sampling of the bits inside half the symbol time, is reproduced at the output of the low-pass filter 38.

By virtue of this time delay in the demodulator 32 and of a similar time delay in the modulator 20, two perfectly complementary signals S, S' are obtained at the inputs of the comparator 22. With this object, it is also necessary, naturally, to compensate for the delay 21 suffered by the data when travelling round the external loop 12 or the internal loop 13. In the first case the delay is due mainly to the transmission/reception filters 28, 30 and to a lesser, but not negligible extent, to the transmission lines 11, 11' which exhibit characteristics which vary with length. In the second case, the delay is very limited and unambiguously defined, depending on the time constants of the modem circuits.

The circuit of the receiver therefore comprises essentially the demodulator 32, the comparator 22, the level meter 31 and the final timer 29.

Figure 6:
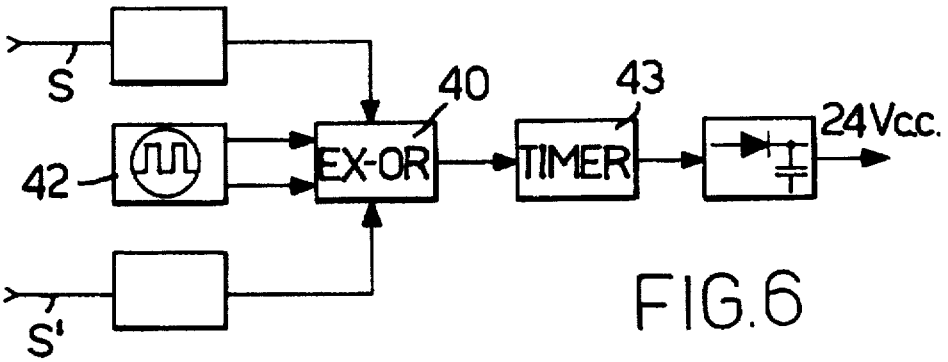
FIG. 6 illustrates a block diagram of the comparator for comparing between a signal modulated directly by the modulator and a transmission signal from the track.

The comparator 22, a bold diagram of which is illustrated in FIG. 6, comprises a dynamic (exclusive OR) gate 40. Data are transferred, by virtue of branch circuits, only when their degree of temporal variation is greater than a specified value, there being a limit to the maximum length of the consecutive ones and zeros. The EX-OR gate 40 produces a one at output only if the inputs relating to the data S, S' are complementary. Contained inside the EX-OR gate 40 is a dynamic (OR) adder to the two inputs of which is transferred a 5 kHz square wave produced by an astable oscillator 42, which is in direct or inverted phase depending on whether a zero is present on the first or second input of the gate.

If a zero is present on both inputs, a DC voltage is generated at the output of the adder but is unable to be transmitted, on account of the presence of a separator transformer, to the final circuit of the EX-OR gate 40 which, under normal conditions, produces a DC voltage of 6.5 V, capable of enabling the subsequent time delay circuit 43. The latter generates a DC output of 24 volts after about 1.5 sec. from the moment at which the enable signal appears at the input and has the property of being able to be almost completely reset within a time equal to that of a bit (2.5 msec). Therefore, disagreement in just one bit every second is sufficient to set the output of the delay circuit 43 permanently and definitely at zero and hence too cause the disabling of the 20 kHz generator 44 and the cancelling of the output from the section 31 for metering the level of the signal received.

The time of one second is the maximum time conjectured to be necessary in order to transmit, possibly on two packets of bits which differ from each other but have the same meaning, the entire set of information relating to the spacing and more generally to the maximum permitted speed of the train in transit.

A first function of the comparator 22 concerns verifying that the signal received actually originates in a correct manner from the source which generated it. This is important in relation to the free-circuit information, or free track segment information, insofar as it guarantees that this information is not due to any disturbance signals which may originate either from traction currents caused by an imbalance present in the track circuit or from the other track circuits which use channels with the same carrier frequency and which are installed on the same track. This is possible, because the electrical splices 4 do not constitute a perfect barrier and are subject to drifting which within certain limits cannot be monitored.

To make this checking function effective and definite, data for identifying the track circuit are also transmitted with the data transmitted within the compass of a track circuit.

A second function of the comparator 22 consists checking the functional integrity of the electronic part and in particular to ensure that the latter does not impair the data to be transmitted through the track circuit.

By virtue of the two checking loops 12, 13 this function takes place in a continuous manner both in a free circuit, or free track segment 3, through the external loop 12 and while a train is travelling by on the track segment 3, or in an occupied circuit, through the internal loop 13. Advantageously, an automatic switch means 45 is provided between external loop 12 and internal loop 13, in particular an on/off means switch for the internal loop 13.

Switching takes place at the moment at which the first axle of the train travelling by on the track segment 3 reduces the control current through the level metering section 31 to below a specified threshold value. Under this condition, the output of the amplifier 28' exhibits a level insufficient to drive the demodulator 32. Simultaneously a saturable transformer 45 which directly connects the output of the modulator 20 to the demodulator 32 is desaturated. In free track segment 3, the transformer 45 is, on the other hand, in a condition of saturation and therefore direct connection of the internal loop is definitely interrupted. During occupation of the track segment 3 by a convoy, if the data S, S' at the input of the comparator 22 disagree with each other, the supply to the driver 46 of the power stage of the modulator by the 20 kHz generator 44 is disabled as therefore is the capture of the on-board signal from the convoy in transit.

Even if the check carried out by the internal loop does not involve the driver of the final transistors 461 the power stage 28 and the passive output filter 29, this is considered unimportant for the purposes of safety, since in the event of a fault these components cannot significantly corrupt the information transmitted.

Figure 7:
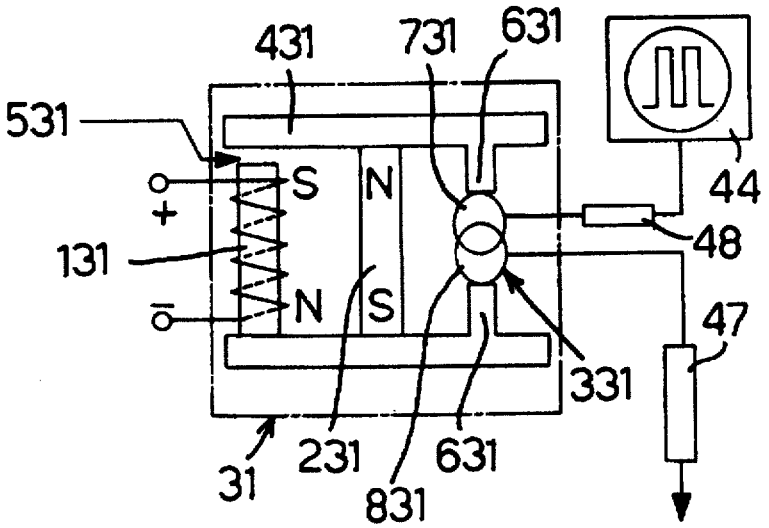
FIG. 7 illustrates a diagram of a particular electromagnetic structure of the fail-safe type which serves to meter the level of the signal received.
Figure 8:
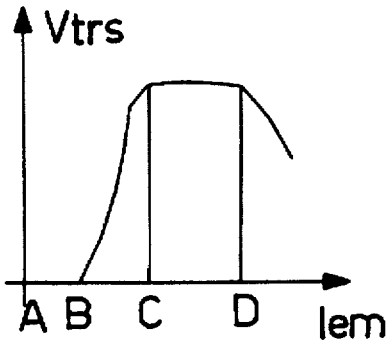
FIG. 8 is a characteristic curve of the output behavior of the aforesaid structure sketched in FIG. 7.

With reference to FIGS. 7 and 8, the device for metering the level of the signal received indicated overall by 31 consists of a magnetostatic relay. This is made up of three elements: an electromagnet 131 to which the signal received by the track segment 3 is applied, a permanent magnet 231 and a transformer 331. These are elements brought together in a single structure 431 comprising two rectangular plates of magnetic material having very low residual magnetism.

The signal provided by the 20 kHz generator 44 is applied to the transformer 331. The permanent magnet 231 placed at the center saturates the transformer 331 since the magnetic flux flows only minimally through the electromagnet 131 on account of the gap 531. The energy produced by the generator 44 therefore fails to reach the load 47 and is almost completely dissipated in the limiting resistor 48.

When a current flows in the electromagnet 131 in a direction such as to create opposite poles relative to those of the magnet 231 and of a strength such as to draw out a certain share of flux from the magnet, the transformer 331 begins to trigger allowing a small current to pass (point B of the characteristic curve of FIG. 8). The energy Vtrs output by the transformer 331 increases with increasing control current Iem until maximum desaturation of the transformer 331 is attained (point C of the characteristic curve), while for control currents greater than a preset maximum value the electromagnet 131 starts to saturate the transformer 331 so that the energy output by the transformer 331 decreases again (point D of the characteristic curve).

The amplitude of the initial insensitivity region depends on the strength of the flux from the permanent magnet and on the thickness of the gap, which also affects the slope of the characteristic curve and the amplitude of the operating region (C-D). There is a close dependence of the latter on the geometrical characteristics of the core of the electromagnet.

The return curve of the device 31 is little removed from i.e., is similar to, that illustrated and the device exhibits a substantially lower degree of hysteresis than that of an electromechanical relay. From the point of view of the safety of operation, the magnetostatic relay 31 offers substantial guarantees advantages. Thermal variation in the characteristics of the magnetostatic relay is very limited and can be attributed mainly to the thermal behaviour of the ferrite core of the transformer. The demagnetization of the magnet should be excluded since the latter normally works in short-circuit and with a rather lower induction than the maximum possible. Additionally, each time the electromagnet 131 is fed with by the current required to trigger the transformer 331, or fuel track circuit, the magnet 231 is "re-energized".

According to a further characteristic, the output transformer 331 has two magnetically separated ferrite cores 631. The primary core 731 and the secondary core 831 are wound half on one and half on the second of the two cores. Therefore, the saturation due to the permanent magnet 231 produces identical effects on the two half-waves of the sinusoidal output voltage. Moreover, in the absence of energy at the primary 731, any variations in flux in the transformer, caused by alternating currents flowing in the electromagnet, produce no output signals.

The use of a 20 kHz generator for the transmission of energy at output makes it possible to achieve relatively small dimensions for the magnetostatic relay 31, i.e., to make the relay 31 small.

By virtue of its particular construction the magnetostatic relay 31 exhibits a magnetic AND gate function. Thus, an output signal is delivered to the secondary 831 of the transformer 331 only when both an alternating signal is present at the primary 731 of the latter and a DC or pulsed monopolar signal is present on the control electromagnet 131. By virtue of this expedient, the track segment 3 may be declared free only if both the aforesaid conditions exist, namely when the result of the comparison by comparator 22 between the data transmitted and received is positive and hence an output signal exists at the reception filter 30. In all other cases the track segment 3 will be declared occupied.

The characteristic behaviour between control signal and energy output by the transformer 331 described in FIG. 8 determines that the control voltage must lie between a preset minimum value and preset maximum value. The upper threshold is provided at a level greater than the maximum signal produced under normal conditions. In this way it is possible to monitor any increase in energy received due to a fault or to the drifting of the components of the receiver or of the transmission channel, or else to incorrect regulation of the circuit.

The output from the magnetostatic relay 31 controls a timer or delayer 39. The explanation for the presence or this timer is as follows.

In the event that in free circuit an isolated packet of errors shows up at the input of the comparator 22, and supposing there not to be a delay on de-excitation of the magnetostatic relay 31 of nearly two seconds from the moment of disagreement of the data at the input of the comparator, the output of the magnetostatic relay 31 would immediately go to zero and remain there for about 1.5 s, this being equivalent to the delay inside the comparator 22. In this hiatus or time gap, the circuit would be declared occupied. Since the comparison also occurs with track segment 3 occupied, and therefore the timer 43 inside the comparator 2 is always enabled under normal conditions, if in the phase of occupation of the track segment 3, the receiver were disturbed even by a straightforward sinusoidal signal capable of being transmitted by the reception filter 30 and of a strength such as to cause switchover 45 from the internal loop 13 to the external loop 12, a track segment free indication would be obtained at the output throughout the time during which the output of the comparator 22 remains active on account of the above-indicated delay of 2 seconds on de-excitation.

According to a further important characteristic as regards operational safety it is necessary to guarantee, in the event of a fault, invariance or increase in the delay times and invariance or decrease in the recovery times of the timers 39 and 43, the delay being generated by charging a capacitance through a resistor. However, in this case means are provided for rapidly and partially discharging the capacitance until a pre-specified lower voltage level is reached, when this voltage, once the prescribed delay time has elapsed, has attained a certain upper threshold value. Once the above-mentioned lower threshold value has been reached, the capacitor is rapidly recharged to the upper level (by means of a fast charging network) and on reaching it, the capacitor is again discharged, thus alternating phases of discharging with phases of charging between the two voltage levels, lower and upper. Therefore, with the help of these levels, it is possible to create an oscillation whose period is appreciably smaller than the initial charging period and which can be checked using passive filters. Furthermore, on removing or desupplying the input, the capacitor is discharged on the same network with which the discharge oscillation was generated. Therefore, the discharge time is extremely short and can be neglected relative to the initial charging time. In the event of a decrease in the capacitance value or a decrease in the upper threshold level for charging, an increase is obtained in the frequency generated. On the other hand, an increase in the resistance of the on/off switch employed for rapid discharging leads to an increase in one of the two half-periods of the oscillation and hence to a lowering of the frequency. With a passive filter it is therefore possible to control correct operation and hence to disable the output in the event of a decrease in the prescribed delay time or an increase in the recovery time of the timers.

We claim:

1. A track circuit for a railway system including a track formed by rails, having a longitudinal axis and comprising a plurality of successive track segments, said track circuit comprising a track segment of preset length which is electrically isolated from adjacent segments by electrical splices at opposite ends thereof, said electrical splices each comprising a splice conductor connecting the rails together at opposite ends of each track segment and having an "S" shape laid flat and extending along the longitudinal axis of the track, each splice conductor having axially extending branches arranged along internal sides of corresponding rails, said track circuit further comprising a stationary ground transmission unit and a stationary ground reception unit for each track segment and corresponding on-board reception units on trains in transit along the track, said stationary ground transmission units transmitting data to, and receiving data from, the on-board units through the rails of a corresponding track segment when a train travels on said corresponding track segment, each track segment being connected to a compensation network comprising a plurality of capacitors connected to the rails of that track segment, transmission of the data by said stationary ground units taking place at an autofrequency range frequency and using Minimum Frequency Shift Keying modulation/demodulation, and said data being coded as digital signals, said track circuit comprising six transmission/reception channels for transmission and reception of said data, each of said channels having a different carrier frequency and an identical preset bandwidth, said six transmission reception channels comprising a first three transmission reception channels for transmission/reception on a track associated with a first train travel direction and a second three transmission/reception channels for transmissions/receptions on a track associated with a second, opposite train travel direction.

2. A track circuit according to claim 1, wherein said channels have an overall transmission band having a lower extremity of on the order of 2 kHz and each channel has a center frequency equal to 2.1 kHz+n$B_c$ where n is a integer between 0 and 5 inclusive and $B_c$ is the bandwidth of each channel and is equal to 400 Hz.

3. A track circuit according to claim 2, wherein said lower extremity is 1.9 kHz.

4. A track circuit according to claim 1, wherein the length of the electrical splice depends on the transmission frequency and on the reception frequency for the segment associated with that splice, the splice conductor including turns of greater and lesser length extending along the axis of the track, and the turn of greater length being associated with a track segment in which transmission/reception takes place through a channel having frequencies below those of an adjacent channel.

5. A track circuit according to claim 4, wherein each electrical splice has ends having a shunt resistance of not less than 0.5 ohms.

6. A track circuit according to claim 5, wherein each electrical splice has a maximum permissible conductance of 0.2 S/km.

7. A track circuit according to claim 1, wherein each track segment has a maximum length of 2000 m, and a compensation capacitor of said compensation network having a value of 25 μm is provided every 100 meters.

8. A track circuit according to claim 1, wherein the stationary ground reception and transmission units are grouped in boxes and connected to a corresponding track segment, at a corresponding electrical splice, by means of cables having a maximum length of 7 km, and wherein a inductive compensation means is provided for cables of a length greater than 3.5 km.

9. A track circuit according to claim 8, wherein the stationary ground transmission and reception units are connected to corresponding electrical splices by means of tuning capacitances which increase the equivalent impedance of the corresponding electrical splices and allow the transmission of energy over the track.

10. A track circuit according to claim 1, wherein the stationary ground reception and transmission units relating to a particular track segment are integrated into a single container, and wherein a switchover means is provided for connecting the input of the reception unit and the output of the transmission unit, respectively, to a transmission cable and to a reception cable.

11. A track circuit according to claim 10, wherein said transmission and reception cables are of different lengths and wherein said container includes therein at least one impedance connected in series with a shorter one of said cables to provide electrical equalization of the lengths of said cables.

12. A track circuit according to claim 1, wherein the transmission and reception units include a modulation section and a demodulation section for each modulation/demodulation frequency, said sections being located physically close together and being connected together by an internal loop for internal checking of the data to be transmitted, said internal loop comprising a comparator which compares the data to be transmitted, and a modulating signal comprising data obtained from demodulation of a modulated signal transmitted to the corresponding track segment, said comparator providing selective disabling and enabling of a power section of the transmitter and for sending of information signals relating to the corresponding track segment.

13. A track circuit according to claim 12, wherein said transmission and reception units further comprise an external checking loop, said external checking loop comprising the modulation section, cables for connecting the units to the corresponding track segment, the corresponding track segment itself, and the demodulation section.

14. A track circuit according to claim 13, wherein said transmission and reception units further comprise a switch means which alternately activates and deactivates the internal and external checking loops and which is connected to a signal level monitoring device of said units for monitoring a received signal received by the reception unit, and which, when the received signal falls below a preset threshold, produces an output indicating that the corresponding track segment is occupied.

15. A track circuit according to claim 14, wherein said switch means includes a switch circuit for closing and opening the internal loop, said switch circuit comprising a saturable transformer controlled by a reception amplifier for amplifying the received signal, said saturable transformer operating in saturation when the corresponding segment is unoccupied, so as to provide consequent opening of the internal checking loop, and operating in a linear region when the corresponding segment is occupied so as to provide consequent closure of the internal checking loop.

16. A track circuit according to claim 15, wherein the signal level monitoring device comprises a magnetostatic AND gate connected both to the comparator and to the reception amplifier so that a track segment occupied signal is produced either when the segment is occupied and thus the received signal falls below said preset threshold, or when the comparator produces an output indicating that there is disagreement between the data signal transmitted to the modulation section and the corresponding data signal received through the internal loop or external loop and subsequently demodulated and applied to said comparator.

17. A track circuit according to claim 16, wherein the magnetostatic AND gate comprises an electromagnet to the modulated signal received from the track segment is applied, a permanent magnet and an output transformer having a primary winding connected to a 20 kHz signal generator controlled by the comparator, the electromagnet, the permanent magnet and the transformer being integrated into a single common magnetic structure, the electromagnet having a core separated by a gap from the common magnetic structure, the transformer having a secondary winding and a core divided into first and second parts and said primary and secondary windings being wound half on said one part and half on said second part.

18. A track circuit according to claim 17, wherein the magnetostatic AND gate provides a maximum operating threshold, and wherein when said threshold is exceeded, the track segment occupied signal is produced.

19. A track circuit according to claim 18, further comprising two delay circuits, one inside the comparator and another downstream of the signal level monitoring device, said delay circuits comprising further capacitance elements and resistive networks for charging said capacitive elements in such a way that upon reaching, after a preset delay time, a specified maximum level of charge, the capacitance elements are discharged and recharged rapidly and continually between an intermediate level and said maximum level of charge to produce a square wave, and said track circuit further comprising passive filters for disabling said square wave when said delay time decreases a predetermined amount, or a recovery time associated with the delay circuits increases a predetermined amount, with respect to nominal values.

* * * * *